United States Patent [19]

Jeschke

[11] Patent Number: 4,502,387

[45] Date of Patent: Mar. 5, 1985

[54] DEVICE FOR ZONE-WISE METERING OF INK ON AN INK DUCT ROLLER OF AN INKING UNIT FOR PRINTING PRESSES

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 544,593

[22] Filed: Oct. 24, 1983

[30] Foreign Application Priority Data

Oct. 23, 1982 [DE] Fed. Rep. of Germany ..... 3239259

[51] Int. Cl.[3] ..... B41F 31/06

[52] U.S. Cl. ..... 101/365; 101/363

[58] Field of Search ..... 101/365, 350, 363

[56] References Cited

U.S. PATENT DOCUMENTS

| | | | |
|---|---|---|---|
| 1,760,573 | 5/1930 | Wood | 101/365 |
| 3,855,927 | 12/1974 | Simeth | 101/365 X |
| 4,051,782 | 10/1977 | Fernandez | 101/365 |
| 4,242,958 | 1/1981 | Jeschke | 101/365 |
| 4,373,445 | 2/1983 | Köbler | 101/365 |
| 4,385,560 | 5/1983 | Johne et al. | 101/365 |

*Primary Examiner*—Edgar S. Burr
*Assistant Examiner*—John A. Weresh
*Attorney, Agent, or Firm*—Herbert L. Lerner; Laurence A. Greenberg

[57] ABSTRACT

A device for zone-wise metering of ink on an ink duct roller of an inking unit for printing presses, with an ink knife sealed against flowthrough of ink and subdivided zone-by-zone into adjacent elements having respective mutual joints therebetween, which includes respective actuators located in vicinity of the mutual joints between the ink knife elements, the actuators being operable upon the respective two neighboring ink knife elements on either side of the respective mutual joints for varying zone-by-zone the width of a gap located between the ink knife and the ink duct roller.

11 Claims, 7 Drawing Figures

DEVICE FOR ZONE-WISE METERING OF INK ON AN INK DUCT ROLLER OF AN INKING UNIT FOR PRINTING PRESSES

The invention relates to a device for zone-wise metering of ink on an ink duct roller of an inking unit for printing presses, the device having an ink knife sealed against flowthrough of ink and subdivided zonewise into adjacent elements, and actuators for adjusting the ink knife elements.

Instead of the continuous solid ink knives made of spring steel which were formerly used on ink ducts, modern printing presses employ ink knives which are locally weakened on the back thereof in accordance with the individual ink zones (U.S. Pat. No. 2,283,830). In this heretofore known construction, the adjusting screws for setting the individual ink zones are disposed between the weakened regions of the ink knife so that, when a zone is adjusted, the weakened regions on either side of the adjusted zone are intended to provide the compensation to the neighboring zones. It has been shown, however, that, in this construction, even in the case of slight adjustment changes, an influencing of the neighboring zone cannot be ruled out. Depending upon the magnitude of the setting differences between the individual zones, there is also a change in the influence exerted upon the respective neighboring zones. A disadvantage of this heretofore known construction is an inaccurate setting with the result that the setting value of the respective setting elements or actuators does not correspond to the actual ink profile.

In another heretofore known ink metering device, namely in German Published Prosecuted Application (DE-AS) No. 2,228,625, zone-wide individual sections are provided for metering the quantity of ink, the individual sections being adjustable respectively by means of actuators with respect to the ink duct roller. In this connection, it is irrelevant whether the individual sections are formed by slits of a continuous ink knife or whether they are separate ink knife pieces which are disposed adjacent one another. In both versions, it is necessary to cover the individual sections by a foil or film, or a thin ink knife in order to prevent fouling and sticking of the latter to one another. This results in a two-layer construction, the thinner upper layer being expected more or less to match the lower actuators. Of course, this adaptation can take place only incompletely, because the actuators which are offset in stages with respect to one another do not allow a complete adaptation or conformity of the thin covering knife or of the film. A result thereof is that the ink profile, which is provided, does not correspond to the desired value and to the setting of the actuators, respectively. A further disadvantage of this construction is an undefined influencing of the respective neighboring zones so that an exact and reproducible regulation of the ink profile to be transmitted to the inking unit cannot be assumed.

Another heretofore known construction (U.S. Pat. No. 4,318,341) includes an ink knife formed of individual closely adjacent elements which can be adjusted with respect to the ink duct roller by means of actuators. The actuators assigned to each ink knife element, as viewed in the longitudinal direction of the ink knife, are mounted in the center of each element. A disadvantage of this heretofore known construction is that a step-like gradation of the ink stripes occurs on the ink duct roller which must be compensated for in the inking unit with appropriate effort and expense. Furthermore, sealing problems thereby occur at the separation locations between the individual ink knife elements, and the danger arises that, during the operation of the press, the elements will stick to one another due to the ink with the result that there can be no uninfluenced setting of the individual ink knife elements.

It is accordingly an object of the invention so to constuct a subdivided ink knife with the actuators thereof that, due to the position of the individual actuators, a corresponding and therewith reproducible ink profile is obtained on the ink duct roller without the respective neighboring zones being influenced in an undefined manner and wherein a statically determinate support of the ink metering edge is achieved.

With the foregoing and other objects in view, there is provided, in accordance with the invention, a device for zone-wise metering of ink on an ink duct roller of an inking unit for printing presses, with an ink knife sealed against flowthrough of ink and subdivided zone-by-zone into adjacent elements having respective mutual joints therebetween, comprising respective actuators located in vicinity of the mutual joints between the ink knife elements, the actuators being operable upon the respective two neighboring ink knife elements on either side of the respective mutual joints for varying zone-by-zone the width of a gap located between the ink knife and the ink duct roller.

An advantage of the new construction is that the ink knife is so adjusted by the actuators with respect to the ink duct roller that the resulting ink profile corresponds to the respective current position of the actuators so that it is always possible also to implement a reproducible control, for example, by means of a given program. Furthermore, the new construction prevents uncontrolled influencing of the neighboring zones and permits precise control by means of exact support of the individual ink knife elements, the covering knife or the covering film being able to follow rather easily the respective contours of the skimming edge.

In accordance with another feature of the invention there is provided a device for zone-wise metering of ink on an ink duct roller of an inking unit for printing presses, with a continuous ink knife sealed against flowthrough of ink and subdivided zone-by-zone into adjacent elements having respective weakened locations therebetween, comprising respective actuators located below and engaging the underside of the ink knife in the region of the weakened locations, the actuators being operable upon the respective two neighboring ink knife elements on either side of the respective weakened locations for varying zone-by-zone the width of a gap located between the ink knife and the ink duct roller.

In accordance with an additional feature of the invention the ink knife is formed of individual, independent ink knife elements, each of the actuators acting upon ends of two respective neighboring ink knife elements in vicinity of and below the mutual joint between the two neighboring ink knife elements, and including a thin elastic skimming film covering subdivided into the individual ink knife elements.

In accordance with a further feature of the invention the actuators are cam levers pivot-mounted on a bearing, and including means for pivoting the cam levers so that respective cams bring the ink knife elements into a varying degree of contact with the ink duct roller, the pivoting means comprising respective stepping motors connected by means of an adjusting spindle and a threaded bushing to a connecting rod which, in turn, is connected to a respective cam lever, and including a potentiometer for indicating the current position of the respective ink knife elements.

In accordance with still another feature of the invention, the cams have a peak roof-shaped slope and support the ink knife elements only in the vicinity of the mutual joints between respective pairs of the ink knife elements, the ink knife elements having recesses formed at the mutual joints substantially up to the skimming edge of the knife.

In accordance with again an additional feature of the invention, each of the actuators comprises an adjusting spindle engaging the ink knife at a respective joint, the adjusting spindle having a sloping section thereof and being adjustably engaged by a support bar for displacing the sloping section in longitudinal direction thereof so as to bring the respective two ink knife elements on either side of the joint into a varying degree of contact with the ink duct roller.

In accordance with a concomitant feature of the invention, each of the actuators comprises an adjusting spindle having a sloping section, the adjusting spindle being longitudinally displaceable for bringing the respective ink knife elements into varying degrees of contact with the ink duct roller through the intermediary of the sloping section.

Other features which are considered as characteristic for the invention are set forth in the appended claims.

Although the invention is illustrated and described herein as embodied in a device for zone-wise metering of ink on an ink duct roller of an inking unit for printing presses, it is nevertheless not intented to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
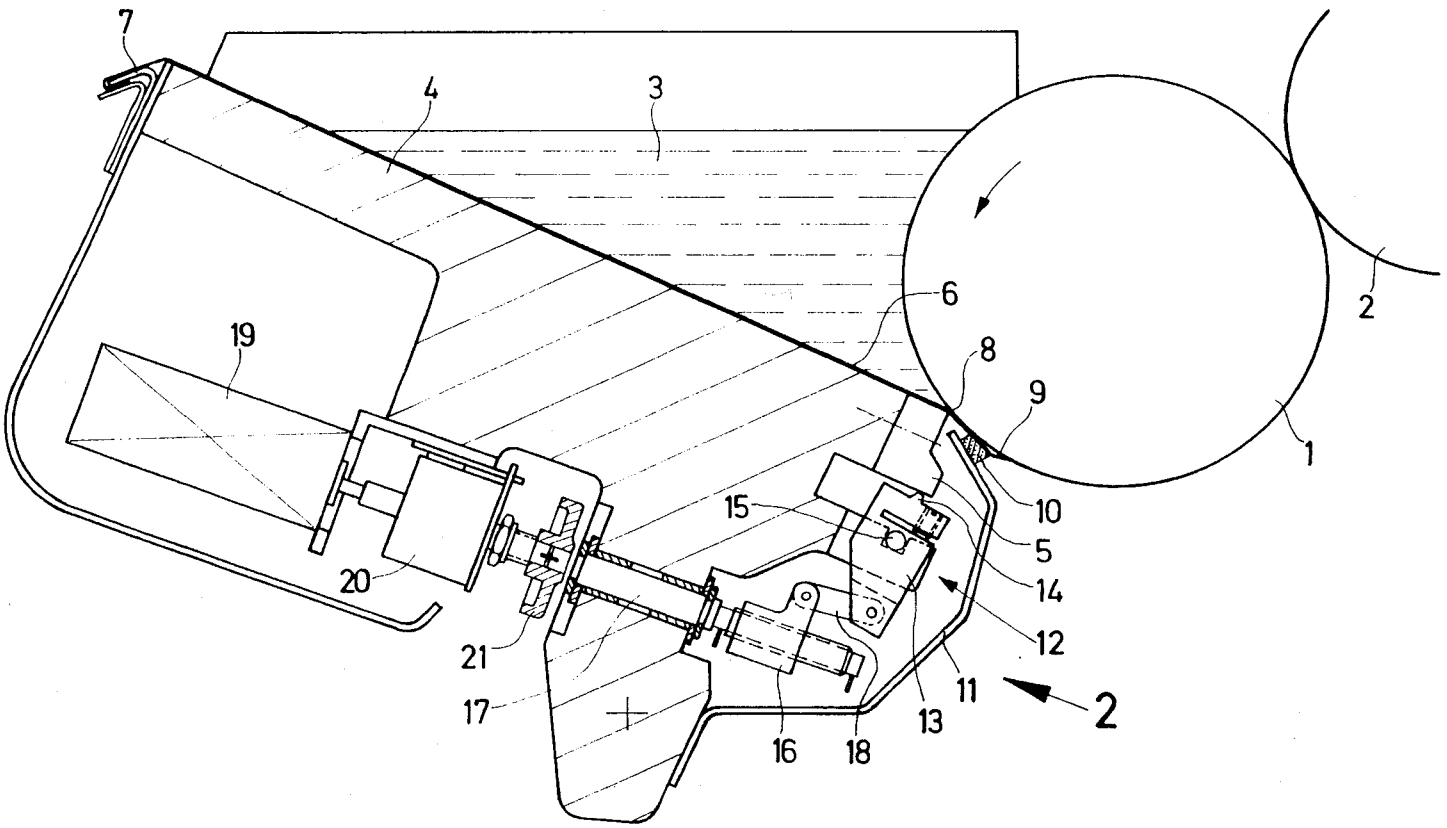
FIG. 1 is a diagrammatic vertical sectional view of an ink duct in a printing unit in accordance with the invention.

Referring now to the drawing and first, particularly, to FIG. 1, there is shown therein an ink duct roller 1 which transfers, in a conventional manner, ink from an ink duct by means of ink duct rollers 2 onto an unillustrated plate cylinder of a printing unit. The ink duct roller 1 receives the ink from an ink supply 3 in the ink duct 4.

Zone-wise metering of the ink on the ink duct roller 1 is performed by ink knife elements 5 which are disposed closely adjacent one another. The ink knife elements 5 and the base of the ink duct 4 are covered by a thin elastic skimming or stripping film 6 which is hooked on hooks 7 in an upper region of the ink duct 4. The ink knife elements 5 are provided with a skimming edge 8 which is so adjustable with respect to the outer cylindrical surface of the ink duct roller 1 that a lesser or a greater extent i.e. a varying degree, of ink can pass between the skimming film 6 and the outer cylindrical surface of the ink duct roller 1 in the region of the skimming edge 8. This permits accurate and acutely sensitive control of the ink quantity on the ink duct roller 1.

The skimming film 6 projects beyond the skimming edge 8 and is in tangential contact with the ink duct roller 1. In an overhanging region 9 thereof, the skimming film 6 is angled towards the ink duct roller 1 in order to return droplets of ink which would otherwise escape in an uncontrolled manner back onto the surface of the ink duct roller 1. The overhanging region 9 is supported on a cover 11 through the intermediary of a soft elastic foam strip 10. The skimming film 6, for example, if damaged, can be exchanged readily for a new film with the result that an as-new condition can be established at very little expense.

Underneath the individual ink knife elements 5, actuators 12 are provided which adjust the gap between the ink knife elements 5 and the outer cylindrical surface of the ink duct roller 1. For this purpose, a cam lever 13 is provided having cams 14 which, when the lever 13 is pivoted about a bearing 15, bring the ink knife elements 5, which are displaceably mounted on the ink duct 4, into varying degrees of contact with the ink duct roller 1. A uniform zero position for all of the ink knife elements 5 is provided at the top dead center of the cam 14.

The cam lever 13 is pivoted by means of a threaded bushing 16 which is mounted on an adjusting spindle 17 and, when the latter is turned, pivots the cam lever 13 to a lesser or greater extent through the intermediary of a connecting rod 18. The adjusting spindle 17 is turned by a stepping motor 19, a potentiometer 20 being provided for indicating the respective current position of the spindle 17 or the ink knife elements 5. This readily affords control of the ink quantity by means of a remote control facility. In order also to be able to perform the zone-wise variation of the ink quantity manually, however, each adjusting spindle 17 is provided with a handwheel 21.

Figure 2:
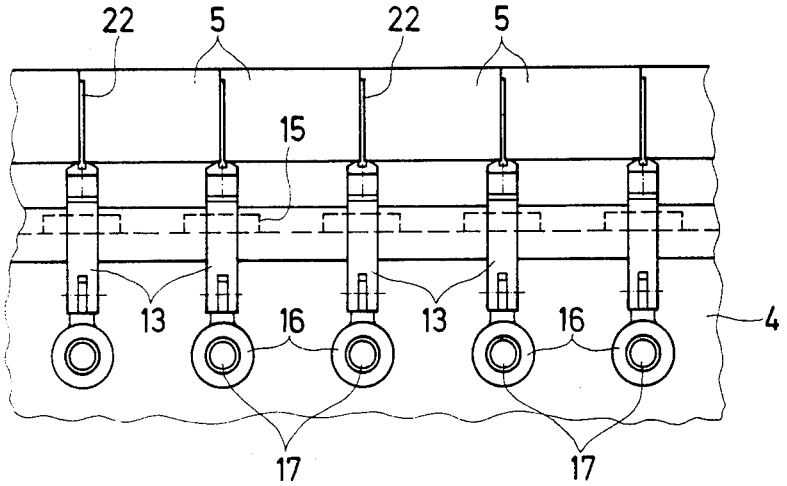
FIG. 2 is a fragmentary view of FIG. 1 in direction of the arrow 2, showing some of the actuators of the device.
Figure 3:
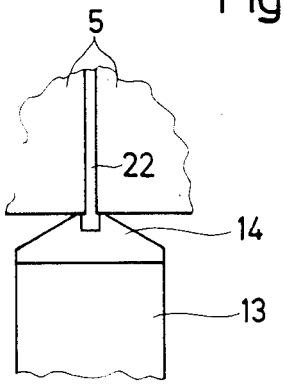
FIG. 3 is an enlarged fragmentary view of FIG. 2 showing one of the actuators and the respective ink knife elements.

FIGS. 2 and 3 show the division of the individual ink knife elements 5 and the cam levers 13 provided in the vicinity of the mutual joints of the ink knife elements 5. In order to prevent a tilting or tipping of the individual ink knife elements 5, the latter are provided in the vicinity of the mutual joints or adjacent sides thereof with recesses 22, so that there is a continuous web or strip at the top thereof, as viewed in FIG. 2, in the region of the skimming edge thereof. These recesses 22 thus permit a tilting or tipping of each individual ink knife element 5 without any lateral pressures being able to arise. FIG. 3 shows that, additionally, the cams 14 slope in the shape of a peaked roof so that they support the ink knife elements 5 only in the vicinity of the mutual joints directly next to the recesses 22. Thus, even in the event of tilting or tipping of the ink knife elements 5, there is no danger of any undesired change of the adjustment or setting.

Figure 4:
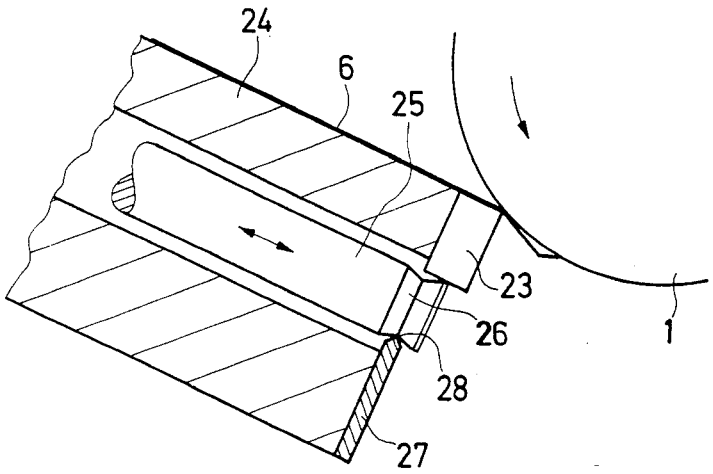
FIG. 4 is an enlarged fragmentary view of FIG. 1 showing one embodiment of the actuator for the ink knife elements.

The embodiment according to FIG. 4 has ink knife elements 23 which are likewise displaceably mounted on the ink duct 24 and adjusted by a longitudinally movable adjusting spindle 25 through the intermediary of a sloping section 26 formed on the latter. The sloping section 26 is supported on a sharp-edged support bar 27 which is attached to the ink duct 24. When the adjusting spindle 25 is longitudinally displaced, the sloping section 26 moves on the blade 28 of the support bar 27 and thus brings two neighboring ink knife elements 23 into a varying degree i.e. to a greater or lesser extent, of contact with the ink duct roller 1.

Figure 5:
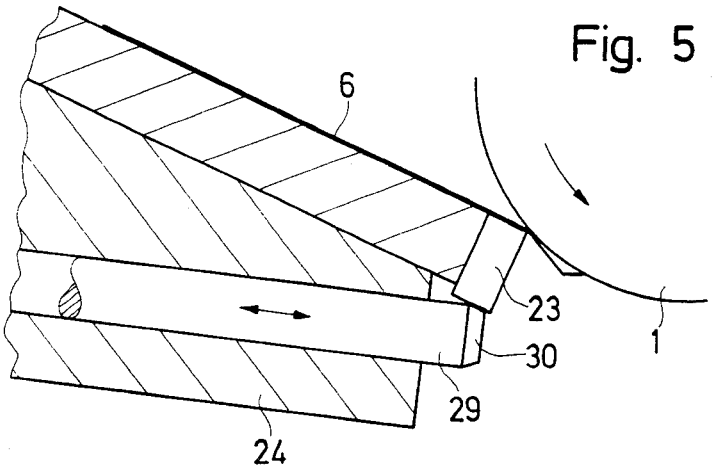
FIG. 5 is a view like that of FIG. 4 showing another embodiment of the actuator for the ink knife elements.

FIG. 5 shows a different embodiment of the invention in a setup similar to that of FIG. 4 wherein the adjusting spindle 29 likewise has a sloping section 30 which, when the adjusting spindle 29 is moved in longitudinal direction, brings the ink knife elements 23 into varying degrees of contact with the ink duct roller 1.

Figure 6:
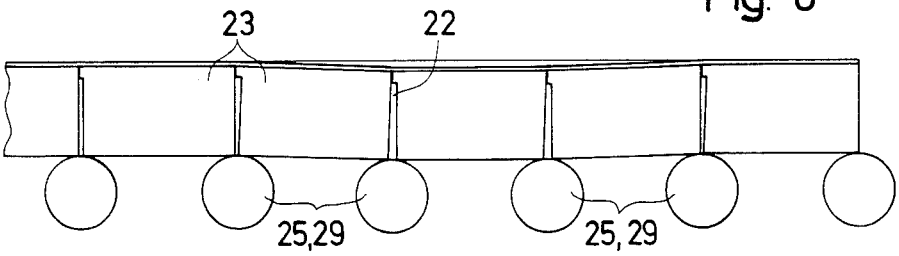
FIG. 6 is a diagrammatic front end view of the individual ink knife actuators.

FIG. 6 shows a front elevational view of the ink knife elements 23 with the adjusting spindles 25, 29 from which it is readily apparent that, in the region or vicinity if the mutual joints of two neighboring ink knife elements 23, the adjusting spindles 25, 29 act upon the ends of the latter and, consequently, as shown, cause an adjustment or setting without any tilting or tipping of the individual ink knife elements 23 which would otherwise cause an undesired adjustment of the latter.

Figure 7:
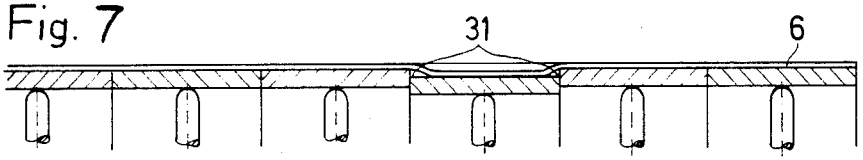
FIG. 7 is a sectional view of an ink knife controlled in accordance with the prior art.

FIG. 7 depicts a situation of incorrect or failed control in the case of the set-back or retracted section which is shown therein. This construction which is known from the prior art illustrates faults 31 which arise due to the limited flexibility of the film 6 in the region of the severed or separated locations of the ink knife zones when the latter have different settings with respect to the ink duct roller 1. This results, in practice, when such a set-back or offset zone is formed, in less ink being transmitted to the inking unit than is intended by the setting.

I claim:

1. Device for zone-wise metering of ink on an ink duct roller of an inking unit for printing presses, with an ink knife sealed against flowthrough of ink and subdivided zone-by-zone into adjacent elements having respective mutual joints therebetween, comprising respective actuators located at the mutual joints between the ink knife elements, said actuators being operable upon the respective two neighboring ink knife elements on either side of the respective mutual joints for varying zone-by-zone the width of a gap located between the ink knife and the ink duct roller.

2. Device for zone-wise metering of ink on an ink duct roller of an inking unit for printing presses, with a continuous ink knife sealed against flowthrough of ink and subdivided zone-by-zone into adjacent elements having respective weakened locations therebetween, comprising respective actuators located below and engaging the underside of the ink knife at the weakened locations, said actuators being operable upon the respective two neighboring ink knife elements on either side of the respective weakened locations for varying zone-by-zone the width of a gap located between the ink knife and the ink duct roller.

3. Device according to claim 1, wherein the ink knife is formed of individual, independent ink knife elements, each of said actuators acting upon ends of two respective neighboring ink knife elements at and below said mutual joint between said two neighboring ink knife elements, and including a thin elastic skimming film covering the ink knife subdivided into said individual ink knife elements.

4. Device according to claim 3, wherein said actuators are cam levers pivot-mounted on a bearing, and including means for pivoting said cam levers so that respective cams bring the ink knife elements into a varying degree of contact with the ink duct roller, said pivoting means comprising respective stepping motors connected by means of an adjusting spindle and a threaded bushing to a connected rod which, in turn, is connected to a respective cam lever, and including a potentiometer for indicating the current position of the respective ink knife elements.

5. Device according to claim 4, wherein said cams have a peak roof-shaped slope and support the ink knife elements only at said mutual joints between respective pairs of said ink knife elements, said ink knife elements having recesses formed at said mutual joints substantially up to said skimming edge of the knife.

6. Device according to claim 1, wherein each of said actuators comprises an adjusting spindle engaging the ink knife at a respective joint, said adjusting spindle having a sloping section thereof and being adjustably engaged by a support bar for displacing said sloping section in longitudinal direction thereof so as to bring the respective two ink knife elements on either side of said joint into a varying degree of contact with the ink duct roller.

7. Device according to claim 1 wherein each of said actuators comprises an adjusting spindle having a sloping section, said adjusting spindle being longitudinally displaceable for bringing the respective ink knife elements into varying degrees of contact with the ink duct roller through the intermediary of said sloping section.

8. Device according to claim 2, wherein said actuators are cam levers pivot-mounted on a bearing, and including means for pivoting said cam levers so that respective cams bring the ink knife elements into a varying degree of contact with the ink duct roller, said pivoting means comprising respective stepping motors connected by means of an adjusting spindle and a threaded bushing to a connecting rod which, in turn, is connected to a respective lever, and including a potentiometer for indicating the current position of the respective ink knife elements.

9. Device according to claim 2, wherein said cams have a peak roof-shaped slope and support the ink knife elements only at said mutual joints between respective pairs of said ink knife elements, said ink knife elements having recesses formed at said mutual joints substantially up to said skimming edge of the knife.

10. Device according to claim 2 wherein each of said actuators comprises an adjusting spindle engaging the ink knife at a respective joint, said adjusting spindle having a sloping section thereof and being adjustably engaged by a support bar for displacing said sloping section in longitudinal direction thereof so as to bring the respective two ink knife elements on either side of said joint into a varying degree of contact with the ink duct roller.

11. Device according to claim 2 wherein each of said actuators comprises an adjusting spindle having a sloping section, said adjusting spindle being longitudinally displaceable for bringing the respective ink knife elements into varying degrees of contact with the ink duct roller through the intermediary of said sloping section.

* * * * *